United States Patent [19]

Morgenthaler et al.

[11] Patent Number: 4,670,305

[45] Date of Patent: Jun. 2, 1987

[54] PROCESS FOR COATING A PIPE INTERIOR WITH CROSS-LINKED BLOCK COPOLYMER

[75] Inventors: Lee N. Morgenthaler, Houston, Tex.; Thomas A. Christenson, Covington, La.; Peter P. Radecki, Jr., Houston, Tex.

[73] Assignee: Shell Oil Company, Houston, Tex.

[21] Appl. No.: 809,110

[22] Filed: Dec. 16, 1985

[51] Int. Cl.[4] ..... B05D 7/22

[52] U.S. Cl. ..... 427/239; 427/388.2; 427/388.5

[58] Field of Search ..... 427/239, 388.2, 388.5

[56] References Cited

U.S. PATENT DOCUMENTS

| | | | |
|---|---|---|---|
| 2,596,844 | 5/1952 | Clark | 252/8.55 R |
| 2,966,401 | 12/1960 | Myerholtz | 252/8.55 R |
| 3,333,024 | 7/1967 | Haefele et al. | 524/534 |
| 3,351,079 | 11/1967 | Gibson | 252/8.55 R |
| 3,416,899 | 12/1968 | Schiff | 252/8.55 R |
| 3,770,490 | 11/1973 | Parker | 427/239 |
| 3,910,856 | 10/1975 | Krukg et al. | 524/530 |
| 4,156,673 | 5/1979 | Eckert | 524/534 |
| 4,391,844 | 7/1983 | Baczek et al. | 427/239 |
| 4,396,658 | 8/1983 | Mettes et al. | 427/239 |

*Primary Examiner*—Norman Morgenstern
*Assistant Examiner*—Janyce A. Bell

[57] ABSTRACT

A pipe coating process capable of coating a pipe string after installing it in a well comprises wetting the pipe string walls with a hydrocarbon liquid containing an initially soluble block copolymer of elastomeric and glassy blocks plus a crosslinking agent for solidifying the polymer, and heating the liquid to solidify the polymer.

5 Claims, 3 Drawing Figures

PROCESS FOR COATING A PIPE INTERIOR WITH CROSS-LINKED BLOCK COPOLYMER

RELATED APPLICATIONS

This application is related to a commonly assigned application Ser. No. 639,752 filed Aug. 10, 1984, now U.S. Pat. No. 4,595,513, by L. N. Morgenthaler and W. J. Mikols on an oil-base well treating fluid thickened by block copolymers. The Ser. No. 639,752 application relates to well treating fluids, for fracturing, gravel, packing, and the like, comprising liquid mixtures of aliphatic and aromatic hydrocarbons containing polymers inclusive of at least one block copolymer and a polymer cross-linking agent effective for temporarily maintaining the viscosity of the solution at a selected high level at the temperatures in a well and reservoir. The disclosures of the Ser. No. 639,752 application are incorporated herein by reference.

BACKGROUND OF THE INVENTION

The present invention relates to coating the interior surfaces of a conduit while it is in place in the situation in which it is to be used. More particularly, the invention relates to treating segmented conduits, such as tubing strings in wells, to provide a corrosion resisting coating throughout all of the interior surfaces, including pipe junctions, and the like.

Various methods and apparatuses for coating various conduits in use locations have been described in U.S. Patents such as the following: U.S. Pat. No. 3,041,204 relates to a method and apparatus for coating pipes or conduits with any desired fluid material, using a fluid-propelled deformable contact head for applying the coating material. U.S. Pat. No. 3,108,012 relates to cleaning, coating, then drying, transmission lines in-situ underground using pumpable barriers forming chambers for receiving the cleaning and treating materials and wiping them along the interior of the line. U.S. Pat. No. 3,355,315 by R. M. Jorda, T. J. Robichaux and N. D. Smith relates to coating pipe interiors with a polyepoxide, preferably by pumping in a solution of a compound possessing amino hydrogen atoms, then a solution containing a polyepoxide, and then allowing the resulting coating to cure along the pipe walls. U.S. Pat. No. 3,394,025 describes a pipe coating apparatus in which coating material is disposed between barrier materials and propelled through the pipe by a fluid pressure behind the barrier members. U.S. Pat. No. 3,598,636 describes coating pipe interiors by pneumatically propelling a coating liquid which is confined between an applicator plug and a retaining plug.

SUMMARY OF THE INVENTION

The present invention relates to coating interiors of metal conduits with adhering cross-linked polymers inclusive of at least one cross-linked block copolymer. A coating liquid is compounded to consist essentially of a liquid mixture of aliphatic and aromatic hydrocarbons containing at least one block copolymer having at least one elastomeric block portion connected to at least one thermoplastic block portion and at least one free radical-forming polymer cross-linking agent that is capable of cross-linking at least one polymer present in that liquid at a selected temperature exceeding the temperature at which the solution is compounded. The kinds and amounts of the hydrocarbons, polymers and cross-linking agents contained in that liquid are correlated with both the selected temperature and a residence time selected for the liquid to be at that temperature. The components of the liquid are arranged so that the bulk of the liquid remains mobile during the cross-linking of the polymers to an extent such that a polymer coating becomes substantially immobilized along the wall of the conduit. The coating liquid is then pumped into and out of the conduits to be coated while a portion of the liquid in contact with the walls of the conduit is heated to the extent required to attain the selected temperature and contact time.

DESCRIPTION OF THE INVENTION

Figure 1:
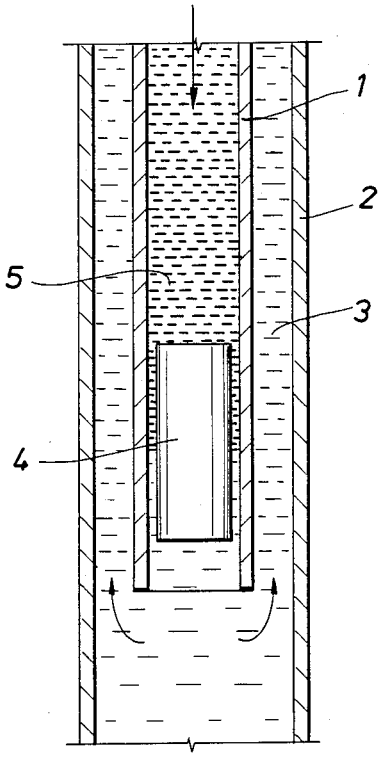
FIGS. 1, 2 and 3 are schematic illustrations of successive stages of applying the present process to a section of tubing string.

Internally plastic coated pipes or other conduits are widely used in the oil field because of their resistance to corrosion or other effects of fluids they contain. As used herein "pipe" refers to continuous or segmented pipes and/or other conduits such as joints, valves, etc. to which such conduits are connected. However, if there are any flaws in the plastic coating, corrosion resistance is lost. Two major problems are cuts in the coating introduced when connecting and running pipe into the well and cuts caused by abrasion during production, etc.

These flaws might be prevented if a coating could be applied in situ, that is, after the pipe is run into the well. Once cuts are detected, the only remedy commonly used at present is to replace the joint of tubing. The process we envision could be applied either upon initial installation of the tubing string or as a remedial treatment.

The present process can comprise preparing a solution of the appropriate block copolymer and activating agent in diesel oil similar to, but probably more concentrated than, those described in the application mentioned above. This solution would then be introduced into the well in a manner causing it to coat the tubing. Such methods might include circulation of the polymer solution into the wellbore followed by circulation of an immiscible fluid such as water or gas that would leave the pipe wet by a thin coating of the polymer solution. Coating thickness could probably be controlled by varying the viscosity and/or velocity of the immiscible fluid.

Alternatively, a mechanical device might be used to place the coating, e.g., as suggested in the patents mentioned above.

The reaction between the polymer and the activator is triggered by elevated temperatures. The required temperature increase might be provided by the natural heating of the well due to geothermal conditions or by application of a chemical heating process such as that described in U.S. Pat. No. 4,330,037.

The following laboratory test was performed to assess the corrosion inhibiting capability of the present process.

Formulation

The base polymer solution was either 12 percent or 20 percent by weight of a styrene butadiene styrene block copolymer with a styrene content of roughly 10 percent and a molecular weight of roughly 200,000. The solvent was a diesel fuel having a flash point of 155° F., containing 60 percent saturated hydrocarbons, 34 percent aromatic hydrocarbons and 6 percent volatile hydrocarbons. The curing agent concentration is expressed in mg per 50 cc of polymer solution and, in every case, the agent was a dialkylperoxide, 2,5-dimethyl-2,5 di(t-butylperoxy)hexane.

Procedure

A sample cell containing a pre-weighed metal sample (each comprising a steel pipe nipple) and 50 cc of polymer solution with the noted amount of curing agent was heated for 12 hours at 300° F. The polymer-treated samples were then lifted out and placed in 1M hydrochloric acid heated to 160° F. for 72 hours, then removed, cleaned and weighed.

Comparative tests were made of a sample of untreated metal, a metal sample dipped in diesel oil and a metal sample dipped in diesel oil thickened by adding 12 percent by weight of the same block copolymer (but without curing agent).

Results

Test results are summarized in Table 1. In the absence of the coating process (Samples 1–3) a weight loss of 2 to 3.3 grams per sample was observed. Samples coated with various formulations of the present invention suffered less weight loss. The 12 percent polymer solution with 1000 milligrams of activator was most effective. This sample (Sample 5) suffered only 20 milligrams of weight loss, roughly 1 percent of that observed in the untreated samples. The samples treated with 20 percent polymer solution were not as well protected as those treated with 12 percent solution because they developed a less adherent coating.

TABLE 1

Corrosion Testing Pipe Coating

| Sample No. | Percent Polymer | Mgs of Curing Agent | Grams of Wt. Before | Grams of Wt. After | Grams of Wt. Loss |
|---|---|---|---|---|---|
| 1* | 0.0 | 0.0 | 26.16 | 23.93 | 2.23 |
| 2** | 0.0 | 0.0 | 26.94 | 23.62 | 3.32 |
| 3 | 12.0 | 0.0 | 26.05 | 23.86 | 2.19 |
| 4 | 12.0 | 500. | 26.85 | 26.76 | 0.09 |
| 5 | 12.0 | 1000. | 26.24 | 26.22 | 0.02 |
| 6 | 12.0 | 1500. | 25.23 | 25.00 | 0.23 |
| 7 | 20.0 | 500. | 28.10 | 27.29 | 0.81 |
| 8 | 20.0 | 1000. | 27.65 | 25.62 | 1.01 |
| 9 | 20.0 | 1500. | 25.87 | 25.43 | 0.44 |

*Untreated Sample
**Sample dipped in diesel fuel only

The drawing shows a way in which the present invention may be utilized to coat the interior of a tubing string hung in a well. FIG. 1 shows tubing string 1 hung within casing 2. At the stage shown, fluid is being pumped in through the tubing 1 and out through the annulus between it and the casing 2. The first inflowed fluid is an aqueous liquid heating solution 3, such as a heat and nitrogen-generating solution described in U.S. Pat. No. 4,330,037. The volume of that solution is sufficient to at least substantially fill the tubing string and the surrounding annulus. The composition of that solution is arranged to delay the heating reaction long enough for the completion of the coating distributing operation and to generate heat for long enough to solidify a film of the coating liquid.

After substantially filling the tubing string and annulus with the heating solution 3, a coating distributing device 4 is positioned within the tubing string at or near the top of the column of that liquid. The device 4 is arranged to be smaller than the interior of the tubing string and to leave a film having a selected thickness between it and the tubing string interior while being light enough to float on the liquid 3.

Liquid 5 comprising an oil based coating solution is pumped into the tubing string upstream of the coating distributing device 4. The density of coating solution 5 is arranged to be less than that of the device 4 so that the latter will not be buoyant within to coating solution. Enough of the coating solution to fill the portion of tubing string to be coated is then pumped in so that the frontal portion of it and the distributing device 4 are displaced to or near the bottom of the tubing.

Figure 2:
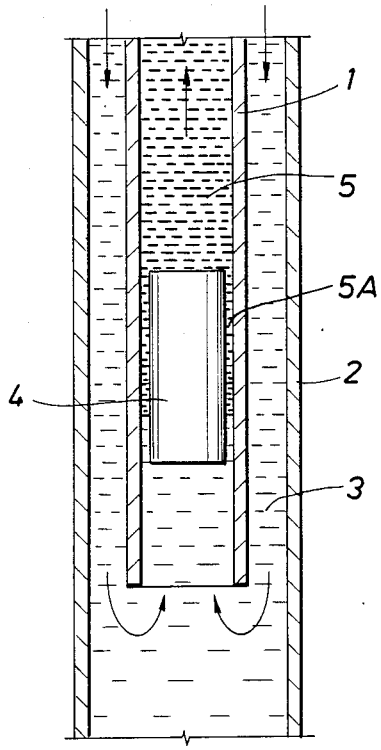

FIG. 2 shows the coating liquid 5 being distributed in a film 5A, along the interior of the tubing string. This is effected by pumping in additional portions of the heat generating solution 3 into and through the annular space between the tubing and the casing. This causes an upward displacement of the coating distributing device 4 and the central portion of the coating liquid 5. Because of the coating liquid viscosity and tendency of the metallic tubing wall to be oil wetted, a film of coating liquid is left on the wall of the tubing.

Figure 3:
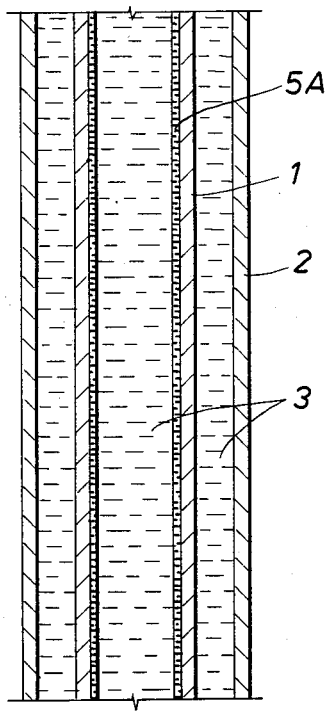

FIG. 3 shows the film 5A of the coating liquid on the interior of the tubing string, completely surrounded by the heat generating solution 3 in the interior portion of the tubing string and the annulus. The reaction of the heat generating solution provides the temperature needed for solidifying the coating material. During the heat generating reaction, the nitrogen released by the reactants is preferably allowed to flow out through the tubing string at a rate which is sufficient to avoid the generation of excessive pressure while causing a relatively slow flow of the reacting solution from the annulus into the interior of the tubing string.

The kinds and amounts of aliphatic and aromatic hydrocarbons within the coating solution are correlated with the kinds and amounts of of polymers in that liquid in order to provide a moderately viscous, but pumpable, liquid at the temperature of the solution compounding location. Such a solution viscosity should be from about 150 to 4000 cp. And, the bulk of the solution should remain pumpable during the selected residence time at the selected temperature.

In an oil-base solution of aliphatic and aromatic hydrocarbons, the initial viscosities of the solution are particularly responsive to the types and amounts of dissolved, or dispersed, polymers. In the present invention, such polymers include arenediene-type block copolymers or mixtures of such copolymers with one or more solution-compatible thermoplastic polymers. As used herein, the term "type of polymers" refers to the molecular weight, structure, amount of chain branching, and the like characteristics of the polymers.

The block copolymers utilized in the present invention can be hydrogenated or non-hydrogenated and can contain relatively few or many double bonds in their diene or arene components. Such polymers having relatively few double bonds can be formed by block copolymerizing monomers (such as butadiene and styrene) and then hydrogenating the products or can be formed by substantially any different synthesis route which produces products that are at least substantially equivalent to those capable of being produced by copolymerizing the unsaturated monomers then hydrogenating the block copolymers. In general, the amount and type of polymers which can be incorporated in order to increase the viscosity of the solution are affected by the kinds of hydrocarbons and the ratio of aromatic to aliphatic hydrocarbons and/or proportions of volatile hydrocarbons which are present in the hydrocarbon solution.

Solution-compatible polymers which can suitably be included in the conduit coating process of the present invention can be substantially any which are capable of being substantially completely dissolved in the block copolymer and polymer crosslinking agent-containing solution at the reservoir temperature and are not adversely affected by the crosslinking reactions of the crosslinking agent. Such solution compatible polymers can comprise, polyolefins, thermoplastic polyesters, poly(aryl esters), poly(aryl sulfones), polyamides, acetal resins, thermoplastic polyurethanes, halogenated thermoplastics, nitrile barrier resins, etc., such as those exemplified in U.S. Pat. No. 4,111,895.

Where desirable, at least some of the block copolymers and/or solution compatible polymers contained in the present conduit coating liquid as it is flowed into the well can comprise small undissolved solid particles or liquid droplets. It is preferable that such particles (or droplets) be homogeneously dispersed and be sufficiently soluble in the oil based liquid to become substantially completely dissolved in that liquid when the temperature of the liquid reaches the reservoir temperature.

As known to those skilled in the art, numerous types of compounds can suitably be used as the free radical-forming polymer crosslinking agents. The crosslinking agents used in the present invention can include azo compounds, alkyl or acyl peroxides or hydroperoxides, ketoperoxides, peroxy esters, peroxy carbonates, and peroxy ketals. Such compounds vary in respect to the temperature at which their reaction is initiated and becomes extensive. Where desirable, one or more of crosslinking agents can be utilized to initiate crosslinking at substantially any temperature between the well site surface temperature and the reservoir temperature. The crosslinking reaction can be started soon enough to cause the conduit treating fluid viscosity to remain substantially constant while the solution is being heated to the reservoir temperature (e.g. during its downward passage through a wellbore) and/or its flowing or static residence time at the ambient temperature of the conduit use location. Examples of suitable crosslinking agents include alkyl peroxides, dialkyl peroxides, hydroperoxides, acyl peroxides and peroxy ketals. Particularly suitable crosslinking agents are: 1,1-bis(t-butylperoxy)-3,3,5-trimethylcyclohexane; benzoyl peroxide; 2,5-dimethylhexane-2,5-di-hydroperoxide; and 2,5-dimethyl-2,5-(t-butylperoxy)hexane.

Where the heating of the film of conduit coating liquid on the walls of the conduit is necessary or desirable, it can be conducted by any of a number of ways, such as circulating steam and/or hot water, running in an elongated heating device, or the like. However, the use of an aqueous chemical heating solution utilizing the reaction of dissolved ammonium ion and nitrite ion containing compounds, such as those described in U.S. Pat. No. 4,330,037 are particularly suitable. The disclosures of that patent are incorporated herein by reference.

What is claimed is:

1. A conduit coating process comprising:

installing a metallic conduit in the situation in which it is to be used;

compounding a conduit coating liquid consisting essentially of a liquid mixture of aliphatic and aromatic hydrocarbons, at least one arenediene-type block copolymer, or a mixture of such copolymer with solution compatible thermoplastic polymer, containing at least one elastomeric block portion connected to at least one thermoplastic block portion, and at least one free radical-forming polymer crosslinking agent capable of crosslinking at least one polymer within the liquid mixture of a temperature which is significantly higher than the temperature at which the pipe coating liquid is compounded;

correlating the kinds and amounts of said hydrocarbon polymer and crosslinking agent in the pipe coating liquid relative to said higher temperature so that the pipe coating liquid is pumpable at the temperature at which it is compounded and remains pumpable at said higher temperature while polymer crosslinking occurs to an extent causing at least a portion of crosslinked polymer to be substantially immobilized against the wall of the pipe, said solution having viscosities of about 150 to 4000 cp; and pumping the conduit coating liquid into and out of the conduit to be coated, while heating that liquid to the extent required to attain said selected higher temperature and flowing it at a rate at which the residence time, at that temperature, is sufficient to cause, in said conduit, immobilization of crosslinked polymer.

2. The process of claim 1 in which the pipe coating liquid is heated by inflowing an aqueous heat generating solution in which the solutes consist essentially of compounds containing ammonium ions and nitrite ions and a reaction-rate-controlling buffer into a heat exchanging relationship with the pipe coating liquid.

3. The process of claim 2 in which the pipe to be coated is filled with the coating liquid and a heat generating solution and a coating distributing device are pumped through the coating liquid in a manner such that a column of the heat generating solution becomes surrounded by a film of coating liquid distributed along the wall of the pipe.

4. The process of claim 1 in which the pipe coating liquid comprises a diesel oil solution of a styrene butadiene styrene block copolymer containing about 10 percent styrene with an average molecular weight of about 200,000 and the polymer crosslinking agent is a dialkylperoxide.

5. The process of claim 4 in which the pipe containing liquid contains about 12 percent by weight of the block copolymer and is heated at about 300° F.

* * * * *